US010801748B2

(12) United States Patent
Scott et al.

(10) Patent No.: US 10,801,748 B2
(45) Date of Patent: Oct. 13, 2020

(54) WATER HEATER WITH TOP WATER OUTLET

(71) Applicant: Rheem Manufacturing Company, Atlanta, GA (US)

(72) Inventors: Timothy D. Scott, Tallassee, AL (US); William Jason Hall, Prattville, AL (US); Brad Windon, Montgomery, AL (US); Brian Shaw, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 203 days.

(21) Appl. No.: 15/856,868

(22) Filed: Dec. 28, 2017

(65) Prior Publication Data

US 2019/0203974 A1 Jul. 4, 2019

(51) Int. Cl.

| | |
|---|---|
| ***F24H 1/20*** | (2006.01) |
| ***F24H 9/18*** | (2006.01) |
| ***F24H 9/12*** | (2006.01) |
| ***F24H 9/02*** | (2006.01) |

(52) U.S. Cl.

CPC ..... *F24H 1/205* (2013.01); *F24H 9/02* (2013.01); *F24H 9/124* (2013.01); *F24H 9/1836* (2013.01)

(58) Field of Classification Search

CPC ..... F24H 1/205; F24H 9/124; F24H 9/1836; F24H 9/02

See application file for complete search history.

(56) References Cited

U.S. PATENT DOCUMENTS

| | | | | |
|---|---|---|---|---|
| 1,933,056 | A * | 10/1933 | Hamilton | F24H 1/205 122/18.31 |
| 4,660,632 | A * | 4/1987 | Yampolsky | F01K 25/08 165/158 |
| 5,687,678 | A | 11/1997 | Suchomel et al. | |
| 7,559,293 | B2 * | 7/2009 | Gordon | F24H 1/205 122/13.01 |
| 7,836,856 | B2 | 11/2010 | Mullen et al. | |
| 8,161,918 | B2 | 4/2012 | Ma et al. | |
| 9,291,401 | B2 * | 3/2016 | Veitch | F28D 7/1623 |
| 9,429,337 | B2 * | 8/2016 | Lannes | F24H 1/205 |
| 2007/0051359 | A1 * | 3/2007 | Missoum | F24H 1/285 126/110 R |
| 2007/0181081 | A1 * | 8/2007 | Missoum | F24H 1/206 122/13.01 |

(Continued)

FOREIGN PATENT DOCUMENTS

WO WO 2017/014853 1/2017

*Primary Examiner* — Nathaniel Herzfeld

(74) *Attorney, Agent, or Firm* — Troutman Pepper Hamiilton Sanders LLP

(57) ABSTRACT

A fuel-fired water heater having a top water outlet includes a water tank and a top cover assembly having the top water outlet to output water from the water tank. The water heater further includes a multi-pass heat exchanger that includes flue tubes positioned in the water tank. The water heater also includes a first plenum and a second plenum at a top end portion of the water heater. The first plenum provides a first hot gas flow path from a first set of the flue tubes to a second set of the flue tubes, and the second plenum provides a second hot gas flow path from a third set of the flue tubes to a fourth set of the flue tubes.

19 Claims, 8 Drawing Sheets

(56) References Cited

U.S. PATENT DOCUMENTS

| | | | | |
|---|---|---|---|---|
| 2009/0165733 | A1* | 7/2009 | Ferguson | F23C 5/08 122/18.3 |
| 2011/0203781 | A1* | 8/2011 | Ellingwood | F24H 1/403 165/173 |
| 2012/0234311 | A1* | 9/2012 | Johnson | F24S 10/72 126/600 |
| 2012/0291719 | A1* | 11/2012 | Steinhafel | F24H 1/00 122/18.3 |
| 2015/0323265 | A1* | 11/2015 | Hodsdon | F28D 7/1676 165/173 |
| 2017/0211845 | A1* | 7/2017 | Deal | F24H 8/00 |

* cited by examiner

WATER HEATER WITH TOP WATER OUTLET

TECHNICAL FIELD

The present disclosure relates generally to water heaters, and more particularly to water heaters with a top water outer outlet.

BACKGROUND

Typical fuel-fired water heaters use fuels, such as natural gas, propane or oil, to heat water contained in a water tank of such water heaters. With such water heaters, a heat exchanger that sits in the tank is typically used to heat the water. In some water heaters, hot gas passes through a heat exchanger once to heat the water. In other water heaters, the heat exchanger may include multiple branches, and the hot gas passes through the heat exchanger multiple times to heat the water. The multiple-branched heat exchanger can result in improved thermal efficiency. However, the arrangement of the multiple branches of the heat exchanger in the tank can present challenges to providing a top water outlet without degrading thermal efficiency of a water heater. In some cases, water heaters with a top water outlet may be preferable. Thus, a solution that allows for the construction of a water heater with a top water outlet and using a multiple-pass heat exchanger may be desirable.

SUMMARY

The present disclosure relates generally to water heaters, and more particularly to water heaters with a top water outlet. In some example embodiments, a fuel-fired water heater having a top water outlet includes a water tank and a top cover assembly having the top water outlet to output water from the water tank. The water heater further includes a multi-pass heat exchanger that includes flue tubes positioned in the water tank. The water heater also includes a first plenum and a second plenum at a top end portion of the water heater. The first plenum provides a first hot gas flow path from a first set of the flue tubes to a second set of the flue tubes, and the second plenum provides a second hot gas flow path from a third set of the flue tubes to a fourth set of the flue tubes.

In another example embodiment, a fuel-fired water heater having a top water outlet includes a water tank and a top cover assembly having the top water outlet to output water from the water tank. The water heater further includes a multi-pass heat exchanger positioned in the water tank, where the multi-pass heat exchanger includes a first-pass flue tube, a first set of second-pass flue tubes, a second set of second-pass flue tubes, a first set of third-pass flue tubes, and a second set of third-pass flue tubes. The water heater also includes a first top plenum at a top end portion of the water heater and a second top plenum at the top end portion of the water heater, where the first plenum provides a first hot gas flow path from the first set of second-pass flue tubes to the first set of third-pass flue tubes and where the second plenum provides a second hot gas flow path from the second set of second-pass flue tubes to the second set of third-pass flue tubes.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
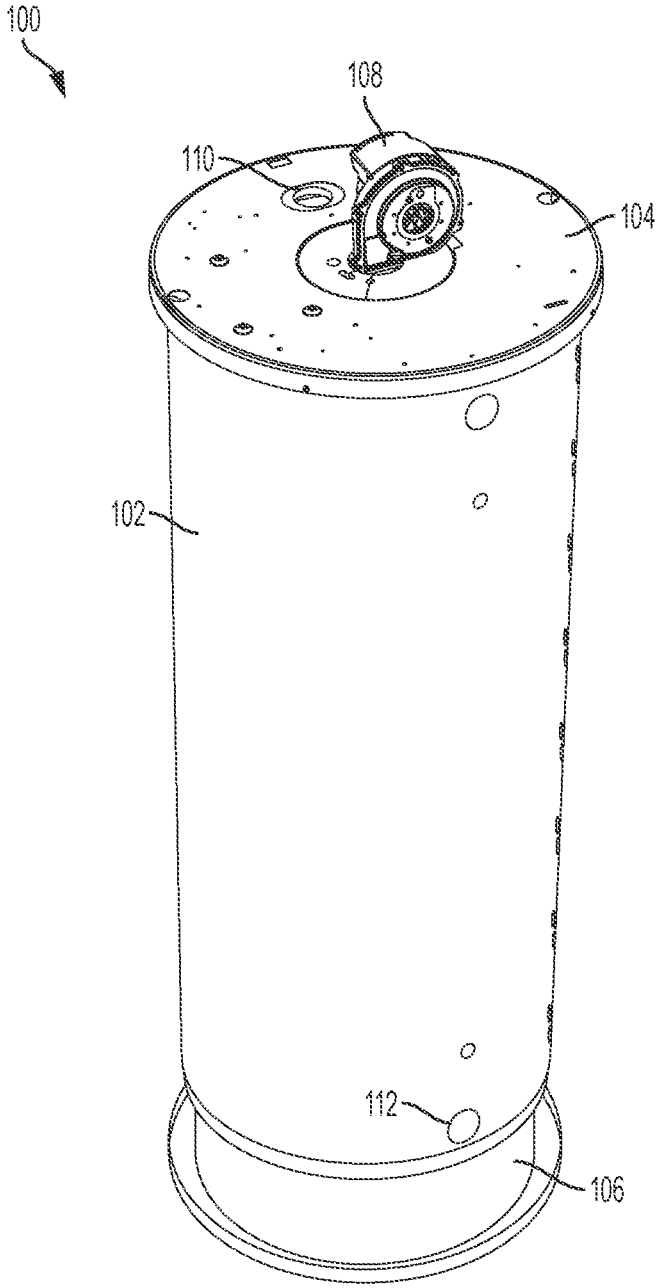
FIG. 1 illustrates a perspective view of a water heater according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a perspective view of a water heater 100 according to an example embodiment. In some example embodiments, the water heater 100 includes water tank 102, a top cover assembly 104, and a bottom assembly 106. The water heater 100 also includes a combustion system 108 at the top end of the water heater 100. For example, the combustion system 108 may include a down-fired burner, where hot gas flows downward into a multi-pass heat exchanger disposed in the water tank 102. The water heater 100 also includes a water inlet 112 that may be disposed, for example, closer to the bottom end of the water tank 102. The water tank 102 also includes a top water outlet 110 through the top cover assembly 104.

In some example embodiments, the top cover assembly includes top flues that interface with second-pass and third-pass flue tubes of the multi-pass heat exchanger. The multi-pass heat exchanger has a configuration that allows the location of the water outlet 110 in the top cover assembly 104 at the top end of the water heater 100. The bottom assembly may also include a bottom flue that interfaces with the third-pass flue tubes of the multi-pass heat exchanger, where the hot gas exits the water heater 100 through a hot gas outlet in the bottom assembly 106.

During operation of the water heater 100, unheated water enters the water tank 102 through the water inlet 112, and gas is heated by the combustion system 108. The unheated water gets heated inside the water tank by hot gas flowing through the multi-pass heat exchanger. The resulting heated water exits the water tank 102 through the top water outlet 110 in the top cover assembly 104. The hot gas that flows through the multi-pass heat exchanger may exit the water tank through a hot gas outlet in the bottom assembly 106.

The water heater 100 provides a top water outlet location along with the high efficiency of a multi-pass heat exchanger. By providing the top water outlet 110, the water heater 100 provides a fuel-fired water heater with a top water outlet location that is preferable in some installations.

In some example embodiments, the water heater 100 and/or one or more components of the water heater 100 may have a different shape than shown without departing from the scope of this disclosure. In some alternative embodiments, the water inlet 112 may be at a different location than shown without departing from the scope of this disclosure. In some alternative embodiments, the top water outlet 110 may be at a different location on the top cover assembly than shown without departing from the scope of this disclosure.

Figure 2:
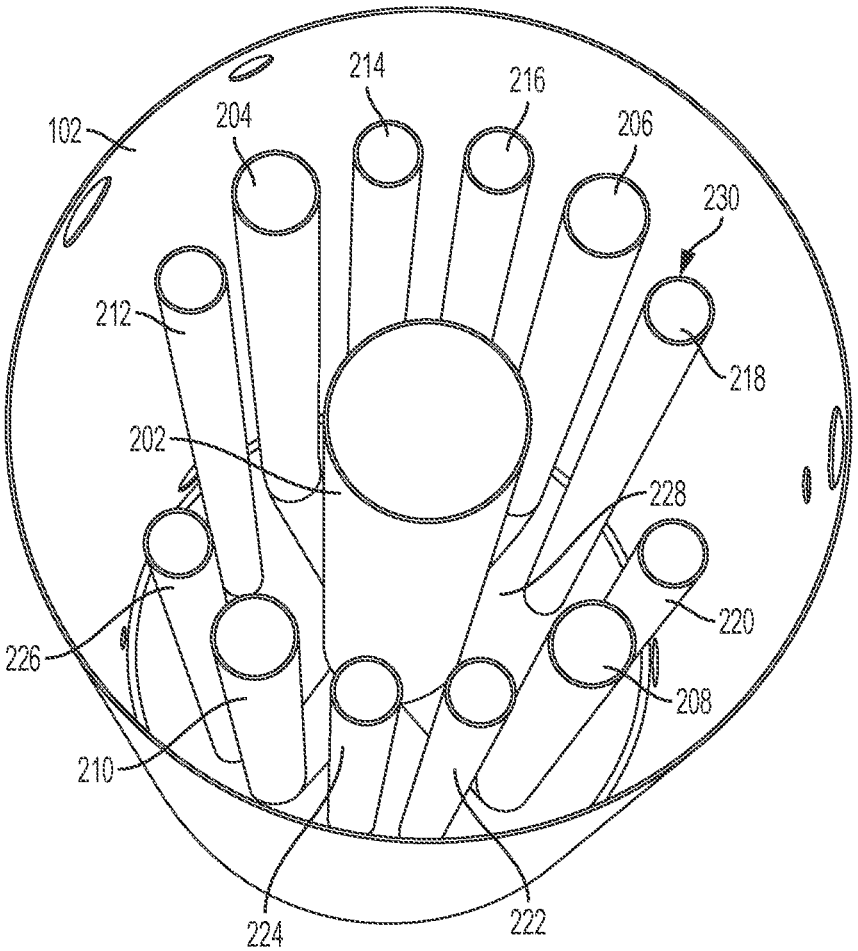
FIG. 2 illustrates a top view of the inside of the water tank of the water heater of FIG. 1 according to an example embodiment.
Figure 3:
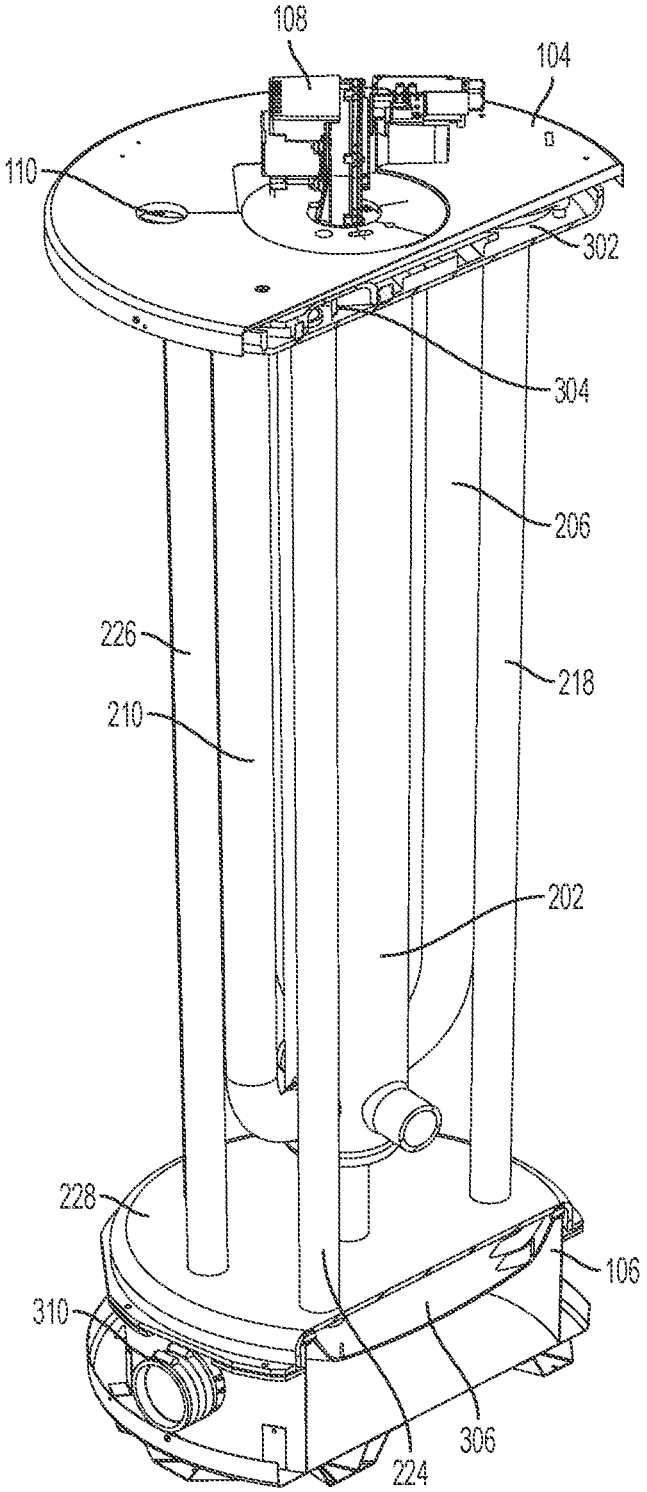
FIG. 3 illustrates a cross-sectional view of the water heater of FIG. 1 without the water tank according to an example embodiment.

FIG. 2 illustrates a top view of the inside of the water tank 102 of the water heater 100 of FIG. 1 according to an example embodiment. FIG. 3 illustrates a cross-sectional view of the water heater of FIG. 1 without the water tank according to an example embodiment. Referring to FIGS. 1-3, in some example embodiments, the water heater 100 includes the water tank 102. A multi-pass heat exchanger 230 is positioned in the water tank 102. The multi-pass heat exchanger 230 includes a first-pass flue tube 202, second-pass flue tubes 204, 206, 208, 210, and third-pass flue tubes 212, 214, 216, 218, 220, 222, 224, 226.

In some example embodiments, the second-pass flue tubes 204-206 extend out radially from the first-pass flue tube 202 and curve/turn generally upward toward the top opening of the water tank 102. The second-pass flue tubes 204-206 are attached to the first-pass flue tube 202 forming a hot gas flow path from the first-pass flue tube 202 to the second-pass flue tubes 204-206. The hot gas in the first-pass flue tube 202 is provided by the combustion system 108, which can be a down-fired system, as more clearly illustrated in FIG. 1.

In some example embodiments, the second-pass flue tubes 204-210 may be substantially parallel to the first-pass flue tube 202 after curving/turning upward. The second-pass flue tubes 204-210 may branch out from the first-pass flue tube 202 proximal to a bottom end of the water tank 102 and may extend upward for a substantial portion of the height of the water tank 102. In some example embodiments, the second-pass flue tubes 204-210 may have curves or other variations in extending upward toward the top opening of the water tank 102. Top ends of the second-pass flue tubes 204-210 may be terminated in top flues in the top cover assembly 104 of the water heater 100 or may otherwise be in fluid communication with the top flues in the top cover assembly 104 of the water heater 100. For example, the second-pass flue tubes 204, 206 may be terminated in a first top plenum 302, and the second-pass flue tubes 208, 210 may be terminated in a second top plenum 304.

In some example embodiments, the third-pass flue tubes 212-226 may extend in the cavity of the water tank 102 from the top end of the water tank 102 to a bottom end of the water tank 102. Top end openings of the third-pass flue tubes 212-226 may be terminated or may otherwise be in fluid communication with the top plenums 302, 304 in the top cover assembly 104. Hot gas from the second-pass flue tubes 204-210 flows to the third-pass flue tubes 212-226 through the top plenums 302, 304 in the top cover assembly 104. For example, the top end openings of the third-pass flue tubes 212-218 may be terminated in the first top plenum 302 to receive hot gas from the second-pass flue tubes 204, 206, and the top end openings of the third-pass flue tubes 220-226 may be terminated in the second top plenum 304 to receive hot gas from the second-pass flue tubes 208, 210.

In some example embodiments, the bottom end openings of the third-pass flue tubes 212-226 may be terminated in the bottom assembly 106 through openings in a top cover 228 of the bottom assembly 106. For example, the bottom assembly 106 may include a bottom flue 306, and hot gas flowing through the third-pass flue tubes 212-226 may flow to the bottom flue 306 and exit the bottom assembly 106 through a hot gas outlet 310 of the bottom assembly 106.

In some example embodiments, the first-pass flue tube 202, the second-pass flue tube 204-210, and the third-pass flue tubes 212-226 may be configured with respect to each other to allow for placing the hot water outlet 110 in the top cover assembly 104 of the water heater 100. For example, the second-pass flue tube 204-210 may be intermingled with the third-pass flue tubes 212-226 around the first-pass flue tube 202. The second-pass flue tubes 204, 206 are less than ninety degrees apart from each other, and the second-pass flue tubes 208, 210 are less than ninety degrees apart from each other. Further, the second-pass flue tubes 204, 206 are each greater than 90 degrees apart from the second-pass flue tubes 208, 210. Each second-pass flue tube 204-210 is also flanked by one of the third-pass flue tubes 212-226, where two of the third-pass flue tubes 212-226 are interspersed between two of the second-pass flue tubes 204-210.

In general, the third-pass flue tubes 212-226 are each spaced from an adjacent one of the second-pass flue tubes 204-210 by the same circumferential distance with respect to the first-pass flue tube 202. As such, compared to third-pass flue tubes that are between second-pass flue tubes separated by less than ninety degrees, extras space exists between third-pass flue tubes that are between second-pass flue tubes separated by more than ninety degrees. To illustrate, the separation between the third-pass flue tubes 212, 226 is larger than the separation between the third-pass flue tubes 214, 216, which are between the second-pass flue tube 204, 206 that are separated by less than ninety degrees. The separation between third-pass flue tubes 218, 220 is larger than the separation between the third-pass flue tubes 222, 224, which are between the second-pass flue tube 208, 210 that are separated by less than ninety degrees. The extra spaces between the third-pass flue tubes 212, 226 and between the third-pass flue tubes 218, 220 allow the water heater 100 to have the top water outlet 110 without degrading the thermal efficiency of the water heater 102.

In some alternative embodiments, the second-pass flue tubes 204-210 and the third-pass flue tubes 212-226 may be interspersed with each other in a different arrangement without departing from the scope of this disclosure. In some alternative embodiments, the flue tubes of the heat exchanger 230 may have different absolute and relative dimensions than shown without departing from the scope of this disclosure. In some alternative embodiments, the heat exchanger 230 may include fewer or more flue tubes than shown without departing from the scope of this disclosure.

Figure 4:
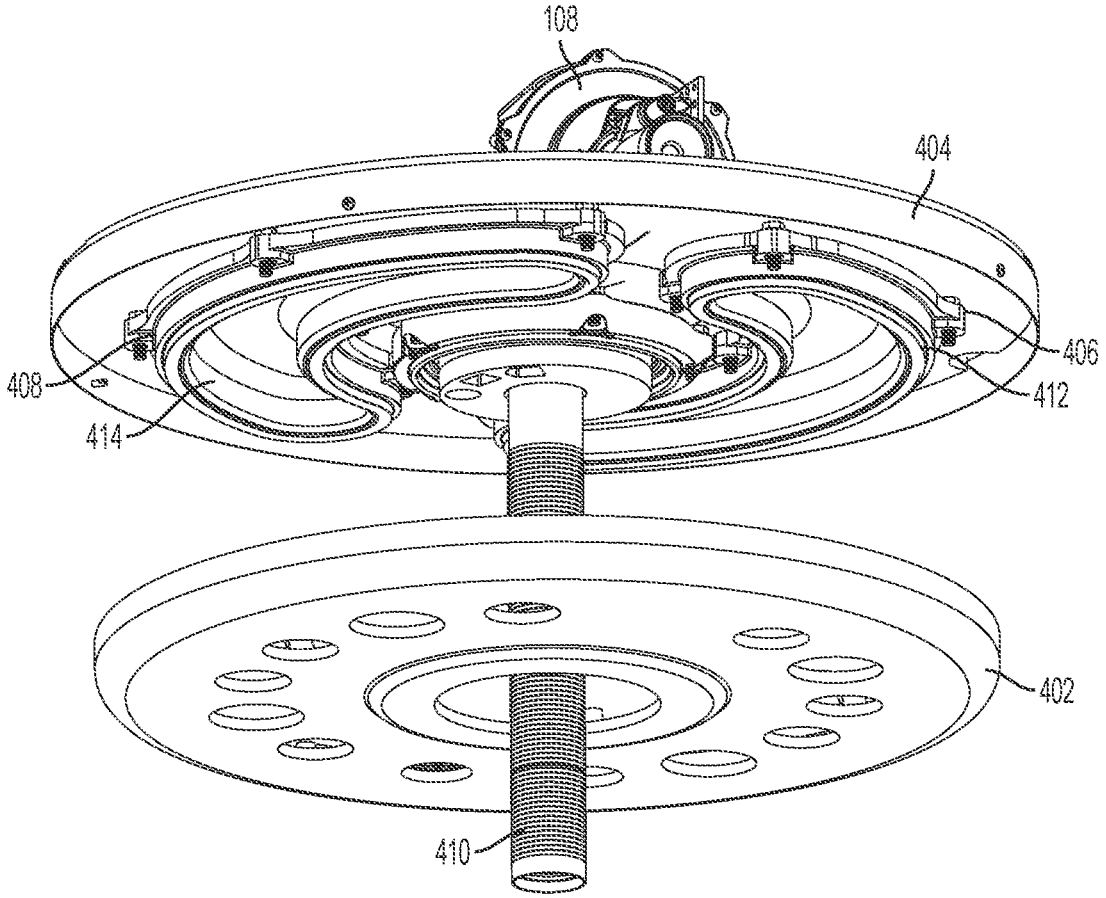
FIG. 4 illustrates a partially exploded view of a top cover assembly of the water heater of FIG. 1 according to an example embodiment.

FIG. 4 illustrates a partially exploded view of the top cover assembly 104 of the water heater 100 of FIG. 1 according to an example embodiment. Referring to FIGS. 1-4, in some example embodiments, the top cover assembly 104 includes a tank cover plate 402, a top cover 404, and flue covers 406, 408. In some example embodiments, the top cover assembly 104 also includes gaskets 412, 414. For example, the gasket 412 may be positioned between the flue cover 406 and the tank cover plate 402, and the gasket 414 may be positioned between the flue cover 408 and the tank cover plate 402.

In some example embodiments, the flue cover 406 and the tank cover plate 402 may define the first top plenum 302, and the flue cover 408 and the tank cover plate 402 may define the second top plenum 304. The gaskets 412, 414 may provide a more reliable seal of the top plenums 302, 304. As more clearly illustrated in FIGS. 5 and 6, the tank cover plate 402 may include holes matching the arrangement of the flue tubes of the heat exchanger 230. In some example embodiments, the combustion system 108 may include a pipe 410 that is inserted into the first-pass flue tube 202 of the heat exchanger 230. For example, the blower of the combustion system 108 may flow air into the first-pass flue tube 202 through the pipe 410.

Figure 5:
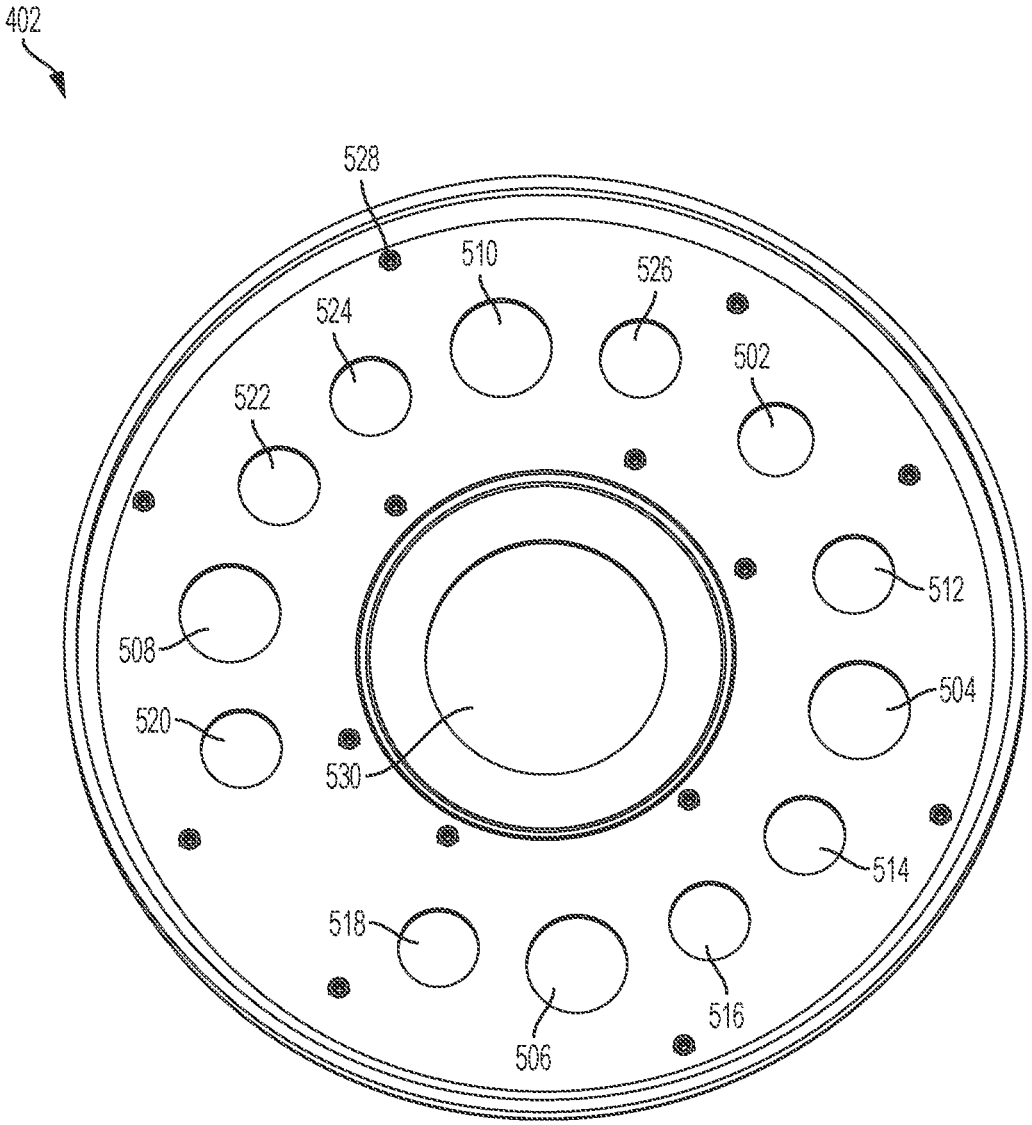
FIG. 5 illustrates a top view of a tank cover plate of the water heater of FIG. 1 according to an example embodiment.
Figure 6:
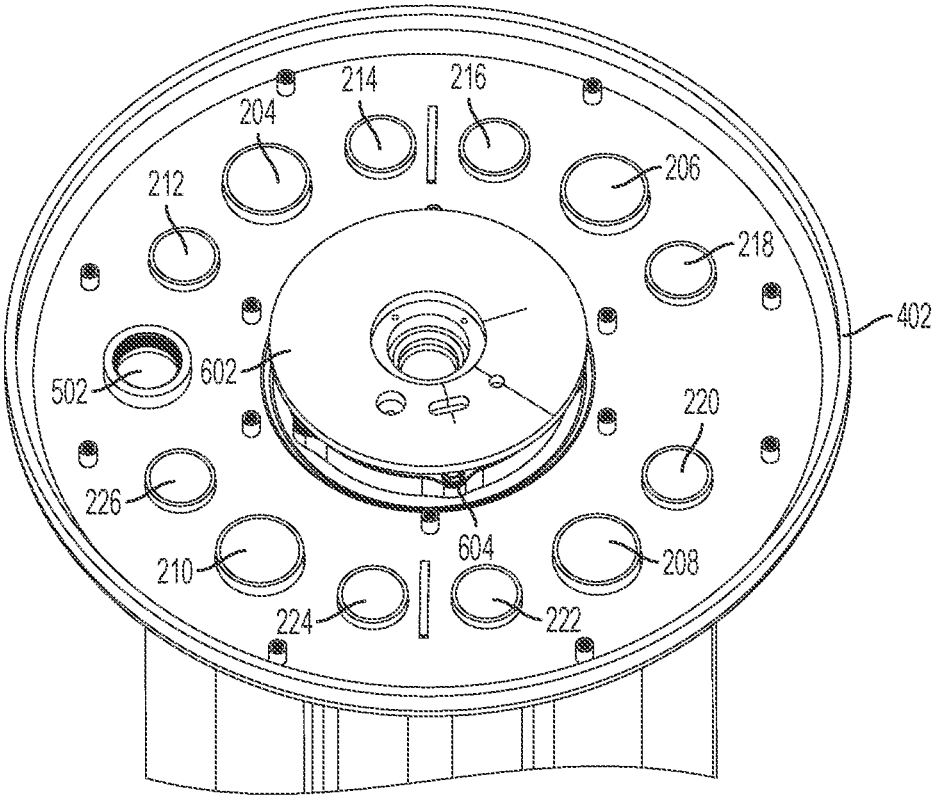
FIG. 6 illustrates the tank cover plate attached to the heat exchanger of the water heater of FIG. 1 according to an example embodiment.

FIG. 5 illustrates a top view of the tank cover plate 402 of the water heater 100 of FIG. 1 according to an example embodiment. FIG. 6 illustrates the tank cover plate 402 attached to the heat exchanger 230 of the water heater of FIG. 1 according to an example embodiment. Referring to FIGS. 1-6, in some example embodiments, the tank cover plate 402 may be positioned at the top end of the water tank 102. The tank cover plate 402 may have holes arranged in a configuration that matches the configuration of the flue tubes of the heat exchanger 230.

To illustrate, the tank cover plate 402 may have tube holes 504, 506, 508, 510 that are sized to receive the second-pass flue tubes 204, 206, 208, 210, respectively. The tank cover plate 402 may have tube holes 512, 514, 516, 518, 520, 522, 524, 526, that are sized to receive the third-pass flue tubes 212, 214, 216, 218, 220, 222, 224, 226, respectively. The tank cover plate 402 also includes a water outlet hole 502 that may be aligned with the top water outlet 110 of the water heater 100. For example, a water outlet pipe may be extended down into the water tank 102 through the water outlet hole 502. By arranging the tube holes 504-510 and the tube holes 512-526 to correspond to the second-pass flue tubes 204-210 and the third-pass flue tubes 212-226, respectively, adequate space is provided in the tank cover plate 402 to place the water outlet hole 502 such that the water heater 100 can include the top water outlet 110 in the top cover assembly 104.

In some example embodiments, a central opening 530 may be positioned to align with the first-pass flue tube 202 and to receive a mounting flange 602 above the first-pass flue tube 202. As shown more clearly in FIG. 4, the pipe 410 may extend into the first-pass flue tube 202 through the hole in the mounting flange 602. The mounting flange 602 may be attached to the tank cover plate 402 using fasteners such as the screw 604.

In some example embodiments, mounting standoffs, such as a mounting standoff 528 may be used to securely attach the flue covers 406, 408 to the tank cover plate 402 using, for example, screws. By using the mounting standoffs, screws that are used to attach the flue covers 406, 408 to the tank cover plate 402 can avoid penetrating through the tank cover plate 402.

Figure 7:
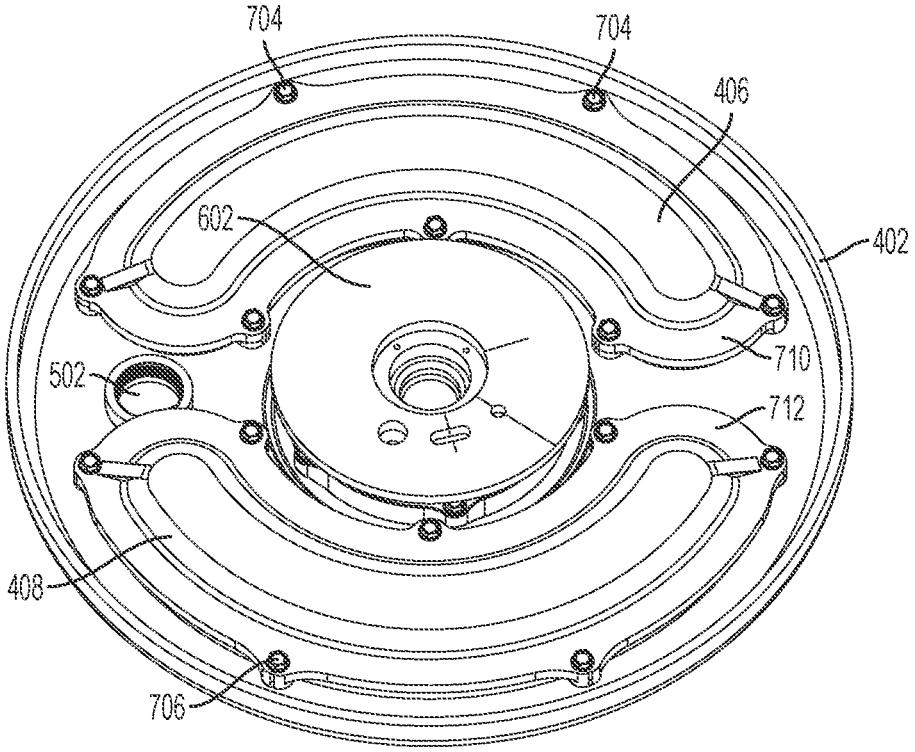
FIG. 7 illustrates the top flue structures including top flue covers and the tank cover plate of the water heater of FIG. 1 according to an example embodiment.
Figure 8:
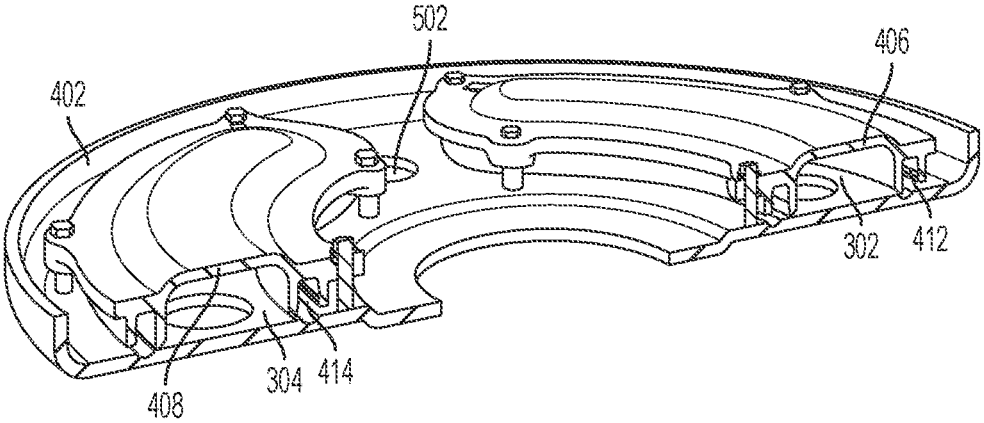
FIG. 8 illustrates a cross-sectional view of the top flue structures of the water heater of FIG. 1 according to an example embodiment.

FIG. 7 illustrates the top flue structures including top flue covers 406, 408 and the tank cover plate 402 of the water heater 100 of FIG. 1 according to an example embodiment. FIG. 8 illustrates a cross-sectional view of the top plenums 302, 304 of the water heater of FIG. 1 according to an example embodiment. Referring to FIGS. 1-8, in some example embodiments, the flue cover 406 is attached to the tank cover plate 402 using fasteners, such as screws 704. The flue cover 408 is attached to the tank cover plate 402 using fasteners, such as the screw 706.

In some example embodiments, the flue cover 406 may be positioned on the tank cover plate 402 covering the tube holes 504, 506, and 512-518, and the flue cover 408 may be positioned on the tank cover plate 402 covering the tube holes 508, 510, and 520-526. As described with respect to FIG. 4, the gaskets 412, 414 can be positioned between the flue covers 406, 408 and the tank cover plate 402 to provide a more reliable seal between the flue covers 406, 408 and the tank cover plate 402.

Because the flue tubes of the heat exchanger 230 are matched with respective holes of the tank cover plate 402, the flue cover 406 covers the second-pass flue tubes 204, 206 and the third-pass flue tubes 212-218 and defines a top flue structure together with the tank cover plate 402. Because the flue tubes of the heat exchanger 230 are matched with respective holes of the tank cover plate 402, the flue cover 408 covers the second-pass flue tubes 208, 210 and the third-pass flue tubes 220-226 and defines another top flue structure together with the tank cover plate 402. The top plenum 302 provides one hot gas flow path from the second-pass flue tubes 204, 206 to the third-pass flue tubes 212-218. The top plenum 304 provides another hot gas flow path from the second-pass flue tubes 208, 210 to the third-pass flue tubes 220-226.

To illustrate, the hot gas is provided by the combustion system 108 through the first-pass flue tube 202, where a portion of the hot gas flows to the second-pass flue tubes 204, 206 and is routed through the top plenum 302 to the third-pass flue tubes 212-218. That portion of the hot gas is then transferred to the bottom flue 306 and exits through the hot gas outlet 310. Another portion of the hot gas from the first-pass flue tube 202 flows to the second-pass flue tubes 204, 206 and is routed through the top plenum 304 to the third-pass flue tubes 220-226. That portion of the hot gas is then transferred to the bottom flue 306 and exits through the hot gas outlet 310.

In some alternative embodiments, the heat exchanger 230 may include fewer or more flue tubes than shown and the tank cover plate 402 may have corresponding number of openings without departing from the scope of this disclosure. In some alternative embodiments, the flue covers 406, 408 may be connected at their respective ends 710, 712 that are away from the water outlet hole 502. For example, the flue covers 406, 408 may be joined to form a generally horse-shoe shaped single flue while allowing the water outlet hole 502 to be in the same position as shown without departing from the scope of this disclosure. In some alternative embodiments, the flue covers 406, 408 may have different sizes and may cover different numbers of the holes of the tank cover plate 402 and corresponding flue tubes of the heat exchanger 230.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A fuel-fired water heater having a top water outlet, the fuel-fired water heater comprising:

a water tank;

a top cover assembly having a top surface, the top water outlet disposed on the top surface to output water from the water tank;

a multi-pass heat exchanger positioned in the water tank, the multi-pass heat exchanger comprising flue tubes;

a first plenum at a top end portion of the water heater, the first plenum having a first end and a second end; and a second plenum at the top end portion of the water heater, the first plenum separate from the second plenum, the second plenum having a first end and a second end, the first end of the first plenum and the first end of the second plenum defining a space, the space including an aperture sized to receive a water outlet pipe through the top water outlet, wherein the first plenum provides a first hot gas flow path from a first set of the flue tubes to a second set of the flue tubes and wherein the second plenum provides a second hot gas flow path from a third set of the flue tubes to a fourth set of the flue tubes.

2. The water heater of claim 1, wherein the first set of the flue tubes are interspersed with the second set of the flue tubes and wherein the third set of the flue tubes are interspersed with the fourth set of the flue tubes.

3. The water heater of claim 2, wherein the first set of the flue tubes and the third set of the flue tubes are second-pass flue tubes and wherein the second set of the flue tubes and the fourth set of the flue tubes are third-pass flue tubes.

4. The water heater of claim 3, wherein the multi-pass heat exchanger includes a first-pass flue tube and wherein hot gas from a combustion system flows through the first-pass flue tube to the first set of the flue tubes and to the third set of the flue tubes.

5. The water heater of claim 4, wherein the top water outlet is located adjacent to a flue tube of the second set of the flue tubes and a flue tube of the fourth set of the flue tubes.

6. The water heater of claim 3, further comprising a bottom plenum proximal to a bottom end of the water heater, where the hot gas enters the bottom plenum from the second set of the flue tubes and the fourth set of the flue tubes.

7. The water heater of claim 4, wherein each flue tube of the first set of the flue tubes is adjacent to two flue tubes of the second set of the flue tubes and wherein each flue tube of the third set of the flue tubes is adjacent to two flue tubes of the fourth set of the flue tubes.

8. The water heater of claim 2, wherein the first set of the flue tubes and the second set of the flue tubes are terminated in the first plenum and wherein the third set of the flue tubes and the fourth set of the flue tubes are terminated in the second plenum.

9. The water heater of claim 8, wherein the first set of the flue tubes are separated from each other by less than ninety degrees with respect to a first-pass flue tube of the multi-pass heat exchanger and wherein the third set of the flue tubes are separated from each other by less than ninety degrees with respect to the first-pass flue tube of the multi-pass heat exchanger.

10. The water heater of claim 8, wherein the top cover assembly includes a tank cover plate having tube holes and a water outlet hole, wherein the tube holes are arranged to match a configuration of the flue tubes, wherein the flue tubes are terminated in the first plenum and the second plenum through the holes, and wherein the water outlet hole is aligned with the top water outlet of the water heater.

11. The water heater of claim 10, wherein the top cover assembly further includes a first flue cover and a second flue cover, wherein the first flue cover and the tank cover plate define the first plenum, and wherein the second flue cover and the tank cover plate define the second plenum.

12. The water heater of claim 1, further comprising a combustion system attached to a mounting flange, wherein the mounting flange is attached to the top cover assembly by one or more screws.

13. A fuel-fired water heater having a top water outlet, the fuel-fired water heater comprising:

a water tank;

a top cover assembly having a top surface, the top water outlet disposed on the top surface to output water from the water tank;

a multi-pass heat exchanger positioned in the water tank, the multi-pass heat exchanger comprising a first-pass flue tube, a first set of second-pass flue tubes, a second set of second-pass flue tubes, a first set of third-pass flue tubes, and a second set of third-pass flue tubes;

a first top plenum at a top end portion of the water heater, the first plenum having a first end and a second end; and a second top plenum at the top end portion of the water heater, the first top plenum separate from the second top plenum, the second plenum having a first end and a second end, the first end of the first plenum and the first end of the second plenum defining a space, the space including an aperture sized to receive a water outlet pipe through the top water outlet, wherein the first top plenum provides a first hot gas flow path from the first set of second-pass flue tubes to the first set of third-pass flue tubes and wherein the second top plenum provides a second hot gas flow path from the second set of second-pass flue tubes to the second set of third-pass flue tubes.

14. The water heater of claim 13, wherein the first set of second-pass flue tubes are interspersed with the first set of third-pass flue tubes and wherein the second set of second-pass flue tubes are interspersed with the second set of third-pass flue tubes.

15. The water heater of claim 13, wherein hot gas from a combustion system flows through the first-pass flue tube to the first set of second-pass flue tubes and to the second set of second-pass flue tubes.

16. The water heater of claim 15, further comprising a bottom plenum proximal to a bottom end of the water heater, where the hot gas enters the bottom plenum from the first set of third-pass flue tubes and the second set of third-pass flue tubes.

17. The water heater of claim 13, wherein the top cover assembly includes a tank cover plate, a first flue cover, and a second flue cover and wherein the first flue cover and the tank cover plate define the first top plenum, and wherein the second flue cover and the tank cover plate define the second top plenum.

18. The water heater of claim 17, wherein the top cover assembly includes a tank cover plate having tube holes and a water outlet hole, wherein the tube holes are arranged to match a configuration of the first set of second-pass flue tubes, the second set of second-pass flue tubes, the first set of third-pass flue tubes, and the second set of third-pass flue tubes.

19. The water heater of claim 13, wherein each flue tube of the first set of second-pass flue tubes is adjacent to two flue tubes of the first set of third-pass flue tubes and wherein each flue tube of the second set of second-pass tubes is adjacent to two flue tubes of the second set of third-pass flue tubes.

* * * * *